US005290147A

United States Patent [19]

Karls et al.

[11] Patent Number: 5,290,147

[45] Date of Patent: Mar. 1, 1994

[54] VARIABLE PITCH MARINE PROPELLER WITH SHIFT BIASING AND SYNCHRONIZING MECHANISM

[75] Inventors: Michael A. Karls, Hilbert; Roger E. Koepsel; Ronald M. Steiner, both of Oshkosh, all of Wis.

[73] Assignee: Brunswick Corporation, Skokie, Ill.

[21] Appl. No.: 801,713

[22] Filed: Dec. 2, 1991

[51] Int. Cl.[5] ..... B63H 3/00

[52] U.S. Cl. ..... 416/34; 416/44; 416/137; 416/139

[58] Field of Search ..... 416/34, 40, 43, 46, 416/136, 137, 139

[56] References Cited

U.S. PATENT DOCUMENTS

| | | | |
|---|---|---|---|
| 1,857,036 | 5/1932 | Wisk | 416/137 |
| 1,863,238 | 6/1932 | Callahan . | |
| 2,005,343 | 6/1935 | Kent | 416/137 |
| 2,052,454 | 8/1936 | Ellwood, II et al. | 416/136 |
| 2,098,100 | 11/1937 | Kaiser | 416/139 R |
| 2,146,367 | 2/1939 | Berliner | 416/136 |
| 2,382,229 | 8/1945 | Humphreys | 416/137 |
| 2,396,811 | 3/1946 | Bathras . | |
| 3,145,780 | 8/1964 | Kean | 416/137 |
| 4,792,279 | 12/1988 | Bergeron . | |
| 4,929,153 | 5/1990 | Speer . | |
| 5,022,820 | 6/1991 | Bergeron . | |

FOREIGN PATENT DOCUMENTS

| | | | |
|---|---|---|---|
| 32532 | 4/1908 | Austria . | |
| 895128 | 10/1953 | Fed. Rep. of Germany . | |
| 1198700 | 8/1965 | Fed. Rep. of Germany | 416/137 |
| 2346912 | 3/1975 | Fed. Rep. of Germany | 416/137 |
| 1142112 | 8/1957 | France | 416/136 |
| 2145479 | 3/1985 | United Kingdom . | |

OTHER PUBLICATIONS

"Everything You Need To Know About Propellers", Third Edition, Mercury Marine Division of Brunswick Corp., Catalog QS5-384-10M, Part. No. 90-86144, p. 6, and FIG. 8, p. 7.

"Handbook of Airfoil Sections For Light Aircraft", M. S. Rice, Aviation Publications, P.O. Box 123, Milwaukee, Wisc. 53201, 1971, p. 69.

*Primary Examiner*—Thomas E. Denion

*Attorney, Agent, or Firm*—Andrus, Sceales, Starke & Sawall

[57] ABSTRACT

A marine propeller includes a hub rotatable about a longitudinal axis and having a plurality of blades extending radially outwardly therefrom and pivotable about respective radial pivot axes between a low pitch position and a high pitch position. A disc has a plurality of guide slots each receiving and retaining a respective lever arm extending rearwardly within the hub from a respective blade. A biasing spring coaxial with the longitudinal axis of rotation of the hub biases the disc to in turn bias the lever arms and blades to the low pitch position. The disc is a generally flat planar plate-like member extending radially outwardly from the longitudinal axis at the rear of the hub and includes a preload mechanism accessible at the rear of the hub for adjusting the bias. The disc restricts movement of the lever arms along the guide slots such that the lever arms can move only in unison, which prevents blade flutter. Pivoting of the blades is controlled by both a) movement of the lever arms along the guide slots, and b) arcuate movement of the guide slots as the disc rotates about the longitudinal axis, such that pivoting of each blade from its low pitch position to its high pitch position requires both a) movement of the respective lever arm along its respective guide slot, and b) rotation of the disc to arcuately move the guide slot.

17 Claims, 12 Drawing Sheets

FIG. 4
PRIOR ART
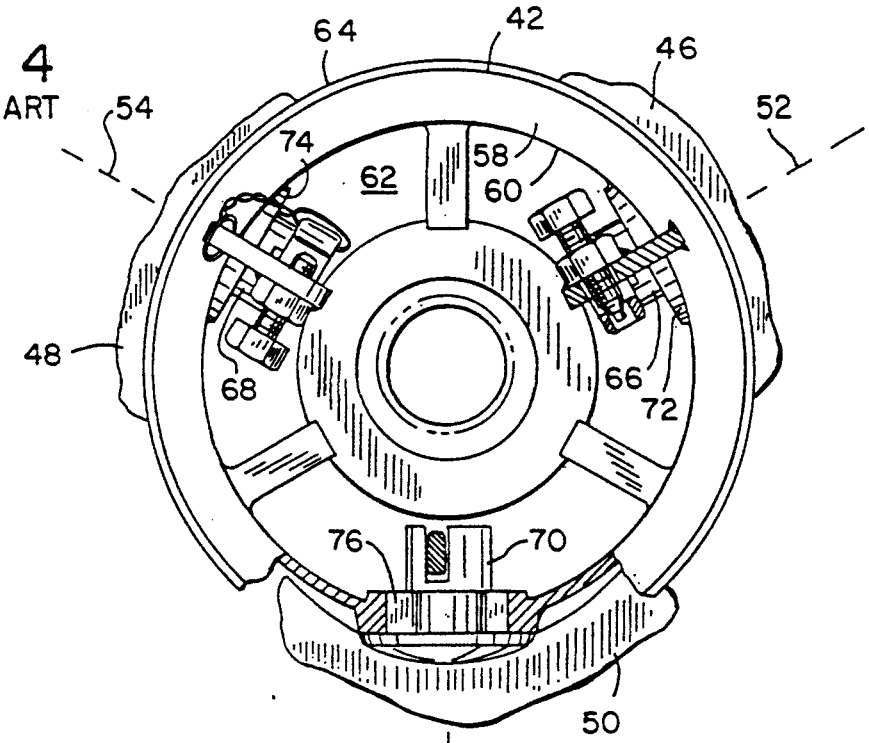
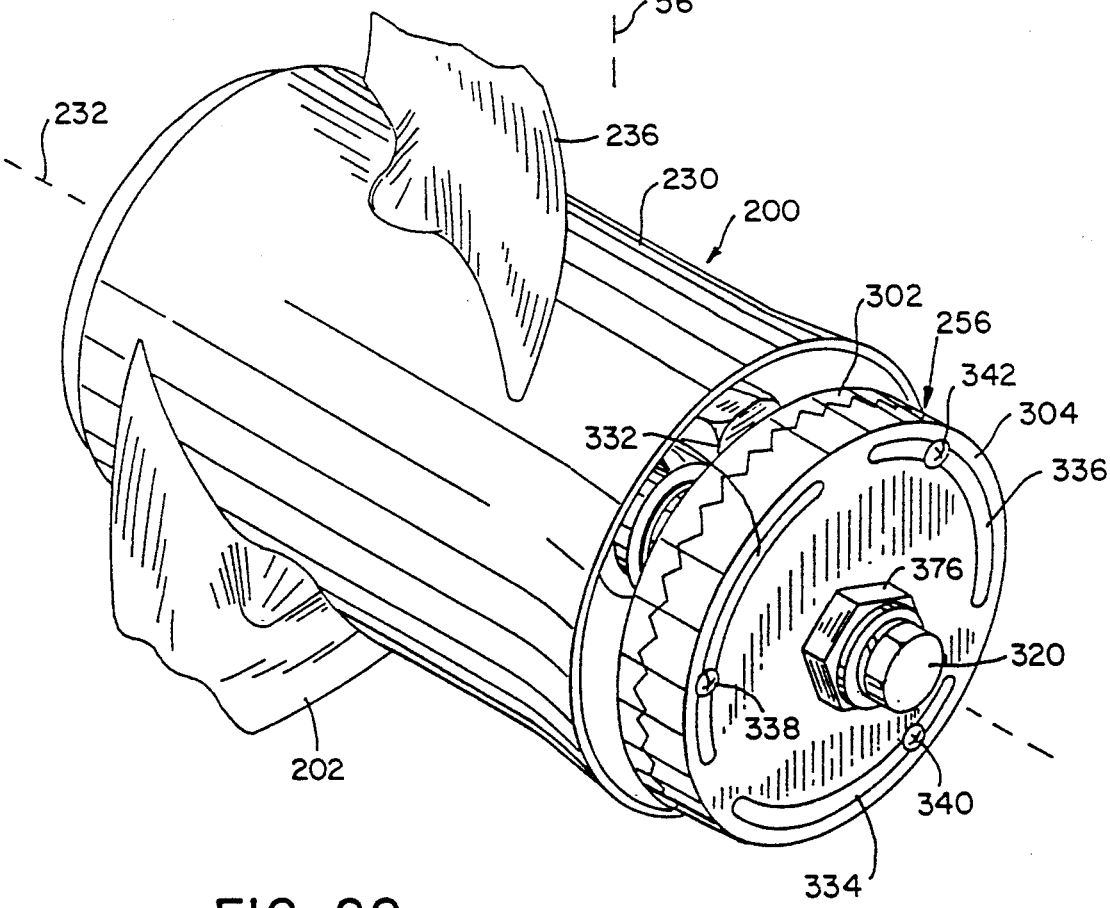
FIG. 22

VARIABLE PITCH MARINE PROPELLER WITH SHIFT BIASING AND SYNCHRONIZING MECHANISM

TECHNICAL FIELD

The invention relates to marine propellers, and more particularly to variable pitch propellers which shift between a low pitch condition and a high pitch condition.

BACKGROUND

Propeller blade pitch is defined as the distance that a propeller would move in one revolution if it were traveling through a soft solid, like a screw in wood, "Everything You Need To Know About Propellers", Third Edition, Mercury Marine Division of Brunswick Corporation, Catalog QS5-384-10M, Part No. 90-86144, page 6, and FIG. 8, page 7. For example, a propeller with a twenty-one inch blade pitch would move forward twenty-one inches in one revolution, a propeller with a ten inch blade pitch would move forward ten inches in one revolution, and so on. Optimum pitch is determined by various factors, including load, speed and boat type. For example, when propelling a boat from rest and for a heavy load, such as towing a water skier, a low pitch propeller is desired. On the other hand, at higher speeds, a high pitch propeller is desired. In the majority of marine propulsion systems, a single pitch propeller is used, and the pitch is selected as a trade-off between the above noted opposing factors.

Variable pitch marine propellers are known in the art. The propeller includes a hub rotatable about a longitudinal axis and having a plurality of blades extending radially outwardly therefrom and pivotable about respective radial pivot axes between a low pitch position and a high pitch position. The blades are initially in the low pitch position for start-up acceleration, and then pivot to the high pitch position at higher speed, for example Bergeron U.S. Pat. Nos. 4,792,279 and 5,022,820 and Speer U.S. Pat. No. 4,929,153. Prior propellers typically use increasing centrifugal force with increasing rotational speed of the propeller to pivot the blades to an up-pitched position, and some propellers use a positive locking mechanism to prevent the shift until a designated threshold centrifugal force is reached.

SUMMARY

The present invention provides a simplified biasing and synchronizing mechanism for the blades of a variable pitch propeller. The mechanism is rugged, durable, and has a minimum number of parts. The blades are biased to the low pitch position, and an easily accessible and adjustable preload mechanism is provided for varying the shift point. Blade pivoting is synchronized such that all blades must pivot in unison, to prevent blade flutter.

A generally flat planar disc is provided at the rear of the hub and extends radially outwardly from the longitudinal axis and includes a preload mechanism accessible at the rear of the hub for adjusting the bias. The disc has a plurality of guide slots each receiving and retaining a respective lever arm extending rearwardly within the hub from a respective blade. A biasing spring preferably coaxial with the longitudinal axis of rotation biases the disc to in turn bias the lever arms and blades to the low pitch position. The disc restricts movement of the lever arms along the guide slots. Pivoting of the blades is controlled by both a) movement of the lever arms along the guide slots, and b) arcuate movement of the guide slots as the disc rotates about the longitudinal axis, such that pivoting of each blade from its low pitch position to its high pitch position requires both a) movement of the respective lever arm along its respective guide slot, and b) rotation of the disc to arcuately move the guide slot.

BRIEF DESCRIPTION OF THE DRAWINGS

FIG. 4 is an end view of a portion of the structure of FIG. 1.

FIG. 22 is a perspective view of the marine propeller of FIG. 19.

DETAILED DESCRIPTION

Figure 1:
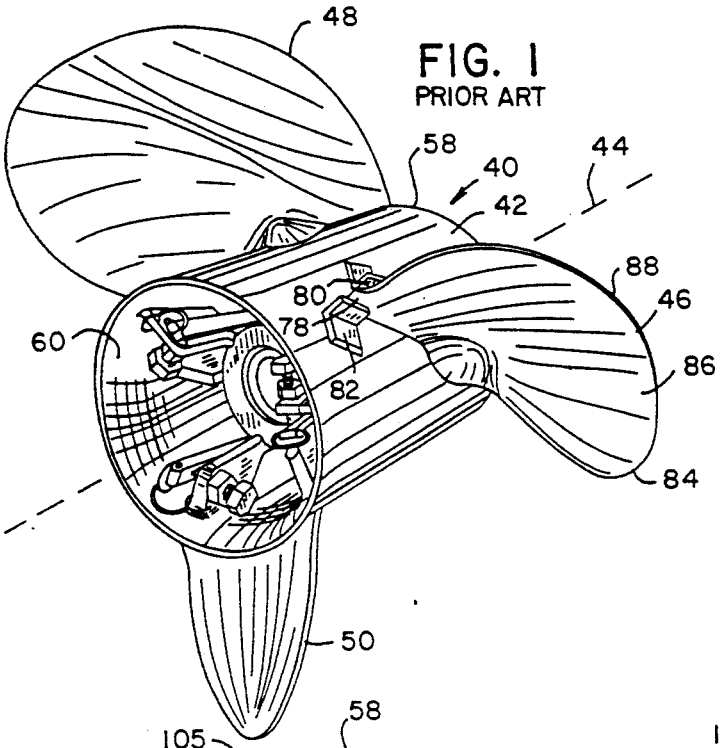
FIG. 1 PRIOR ART
FIG. 1 is an isometric view of an early version of a variable pitch marine propeller developed by applicant.

FIG. 1 shows an early version variable pitch marine propeller developed by applicant. Propeller 40 has a hub 42 rotatable about a longitudinal axis 44 and having propeller blades 46, 48, 50 extending radially outwardly therefrom and pivotable about respective radial pivot axes 52, 54, 56, FIG. 4, between a low pitch position and a high pitch position. Hub 42 has a cylindrical sidewall 58 having an inner surface 60 defining the interior 62 of the hub, and an outer surface 64 defining the exterior of the hub. Trunnions 66, 68, 70 extend radially through cylindrical sidewall 58 and have outer ends attached to respective blades 46, 48, 50, by welding, or by being integrally cast therewith, or the like. Trunnions 66, 68, 70 have inner ends in the interior 62 of the hub. The trunnions are journaled in respective bushings or openings 72, 74, 76 in cylindrical sidewall 58.

Propeller 40, FIG. 1, is a right hand rotation propeller. In the low pitch position, blade 46 is pivoted about its respective radial pivot axis 52, FIG. 4, to rotate trunnion 66 in bushing 72, until the rearward trailing portion 78, FIG. 1, of the blade is stopped against stop 80 which is welded on hub 42. In the high pitch position, blade 46 is pivoted in the opposite direction about its pivot axis 52 until rearward trailing blade portion 78 is stopped against stop 82 which is welded on hub 42. Pivoting of blades 48 and 50 about respective radial pivot axes 54 and 56 is comparable.

Figure 2:
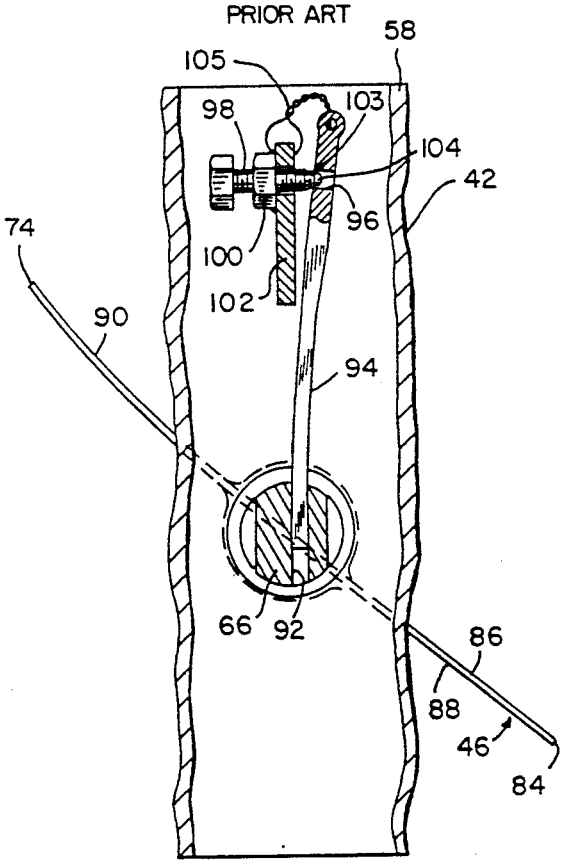
FIG. 2 PRIOR ART
FIG. 2 is a sectional view of a portion of the structure of FIG. 1, and shows a low pitch position of the propeller blade.

Blade 46 has a forward leading portion 84 and a rearward trailing portion 74, a positive pressure frontside surface 86 extending between forward leading portion 84 and rearward trailing portion 74, and a negative pressure backside surface 88, FIGS. 1 and 2, extending between forward leading portion 84 and rearward trailing portion 74 and facing oppositely from frontside surface 86. Positive pressure frontside surface 86 has a concave curvature and is cupped at 90 at the rearward portion thereof, as is known in the prior art, "Everything You Need To Know About Propellers", Third Edition, Mercury Marine Division of Brunswick Corporation, Catalog QS5-384-10M, Part No 90-86144, pages 8, 9. Blades 48 and 50 are comparable.

Figure 3:
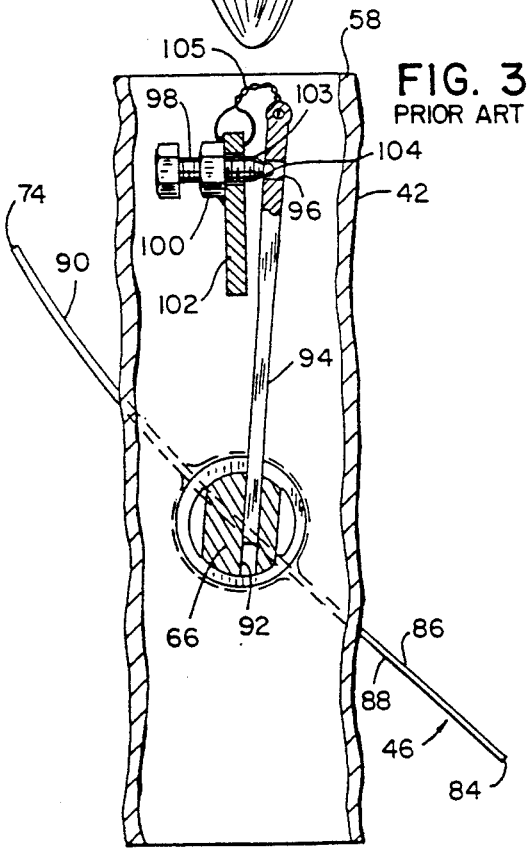
FIG. 3 PRIOR ART
FIG. 3 is like FIG. 2 and shows a high pitch position of the propeller blade.

Trunnion 66, FIGS. 2 and 3, of blade 46 has a slot 92 receiving the forward end of a cantilever leaf spring 94. The rearward end of leaf spring 94 is engaged at opening 96 by the end of a bolt 98 threadingly engaging a nut 100 which is welded to stanchion 102 which in turn is welded to inner surface 60 of cylindrical sidewall 58 of hub 42. Bolt 98 extends through nut 100 and opening 103 in stanchion 102 and has a reduced diameter leading end 104 engaging leaf spring 94 and extending partially into opening 96. Rotation of bolt 98 in nut 100 adjusts the bias on cantilever leaf spring 94. The further that bolt 98 is threaded into nut 100, the stronger the bias applied by leaf spring 94 resisting counterclockwise pivoting of trunnion 66 and blade 46 from the FIG. 3 position to the FIG. 2 position. The rearward end of cantilever leaf spring 94 is connected by a retainer chain and loop 105 to stanchion 102 to prevent loss of leaf spring 94 if it becomes dislodged from trunnion slot 92 during operation.

FIG. 2 shows the low pitch position of blade 46. FIG. 3 shows the high pitch position of blade 46. Cantilever leaf spring 94 biases blade 46 to the high pitch position, FIG. 3. In the at rest condition of the propeller, blade 46 is in the up-pitched position shown in FIG. 3. Upon start-up, as the propeller begins to rotate and provide initial acceleration, water pressure on positive pressure frontside surface 86 of blade 46 immediately causes the blade to pivot counterclockwise to the low pitch position shown in FIG. 2. Even though the blade starts in the FIG. 3 position, water pressure almost immediately downshifts the blade to the FIG. 2 position. The down-pitched position of blade 46 in FIG. 2 is desirable for enhanced acceleration. A strong spring is needed to overcome the water pressure to up-shift the blade and return the blade to the up-pitched position in FIG. 3.

Figure 5:
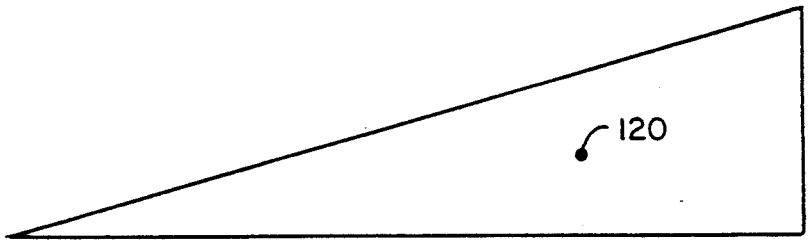
FIG. 5 PRIOR ART
FIG. 5 is a diagram illustrating propeller blade load due to camber (curvature), as known in the prior art.
Figure 6:
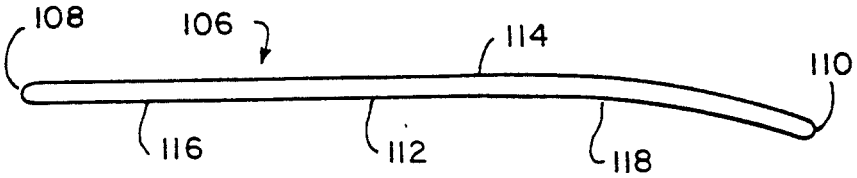
FIG. 6 PRIOR ART
FIG. 6 shows a propeller blade profile, as known in the prior art.

FIG. 5 shows propeller blade load due to camber (curvature) for the propeller blade 106 shown in FIG. 6, as known in the prior art. Blade 106 has a forward leading portion 108, a rearward trailing portion 110, a positive pressure frontside surface 112 extending between forward leading portion 108 and rearward trailing portion 110, and a negative pressure backside surface 114 extending between forward leading portion 108 and rearward trailing portion 110 and facing oppositely from frontside surface 112. The load on the blade due to hydrodynamic force or pressure is smaller along forward section 116 than rearward section 118. This is illustrated in FIG. 5 where blade load increases from front to rear of the blade, i.e. left to right in FIG. 5. The higher blade load along the rearward section of the blade is due to the curvature of the blade, particularly the cupping at section 118 The location of the resultant hydrodynamic force on the blade, or center of pressure, is shown at 120, FIG. 5.

Figure 7:
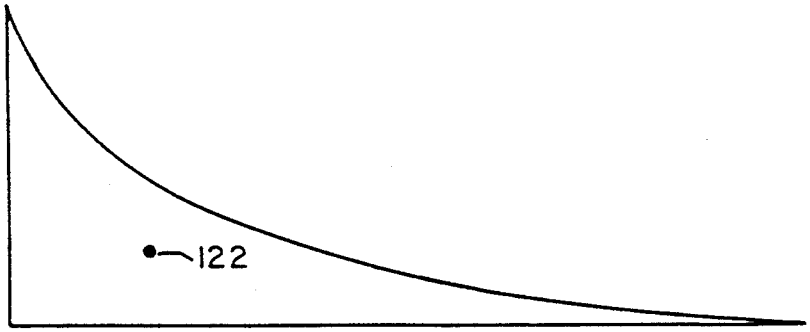
FIG. 7 PRIOR ART
FIG. 7 shows propeller blade load due to angle of attack (slip) at a high angle, as known in the prior art.
Figure 8:
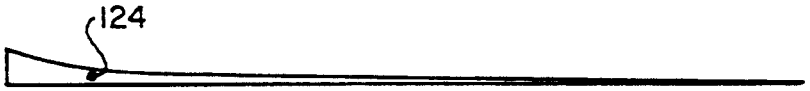
FIG. 8 PRIOR ART
FIG. 8 shows propeller blade load due to angle of attack (slip) at low angle, as known in the prior art.

FIG. 7 shows propeller blade load due to angle of attack (slip) at a high angle. The highest force is at the forward leading portion of the blade, and the force decreases as one moves rearwardly along the blade. The location of the resultant hydrodynamic force, or center of pressure, is shown at 122. FIG. 8 shows propeller blade load due to angle of attack (slip) at a low angle. The magnitude of hydrodynamic force at the forward leading portion of the blade is less than that shown in FIG. 7 because of the lower angle of attack. The magnitude of the hydrodynamic force decreases as one moves rearwardly along the blade. The location of the resultant hydrodynamic force, or center of pressure, is shown at 124 in FIG. 8.

Figure 9:
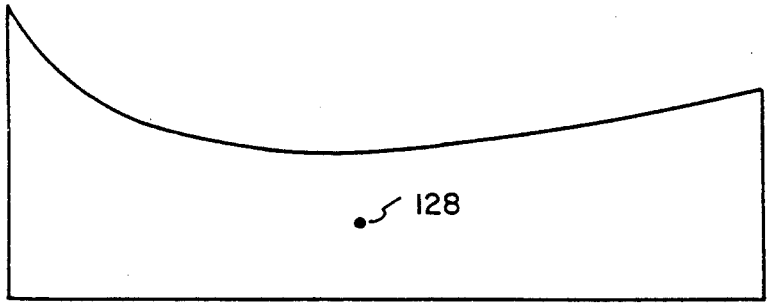
FIG. 9 PRIOR ART
FIG. 9 shows propeller blade composite load due to camber (curvature) and angle of attack (slip) at a high angle, as known in the prior art.
Figure 10:
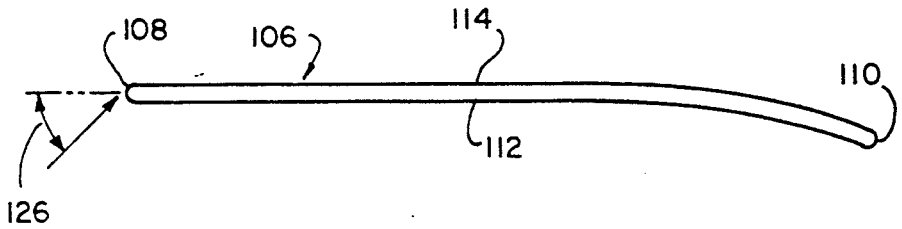
FIG. 10 PRIOR ART
FIG. 10 is a propeller blade profile, as known in the prior art, and shows a high angle of attack.

FIG. 9 shows the composite load on the propeller blade due to camber (curvature) and angle of attack, at a high angle 126, FIG. 10. The load curve in FIG. 9 is the summation of the load curves in FIGS. 5 and 7 for blade 106. The location of the resultant hydrodynamic force, or center of pressure, is shown at 128.

Figure 11:
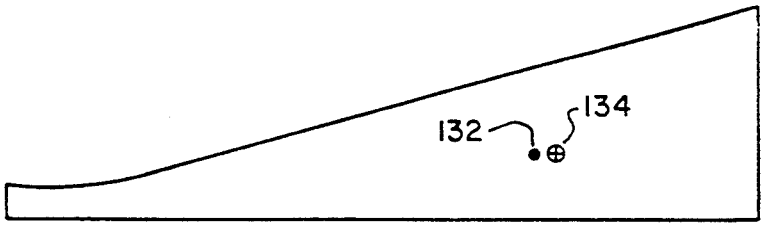
FIG. 11 PRIOR ART
FIG. 11 shows propeller blade composite load due to camber (curvature) and angle of attack (slip) at a low angle, as known in the prior art.
Figure 12:
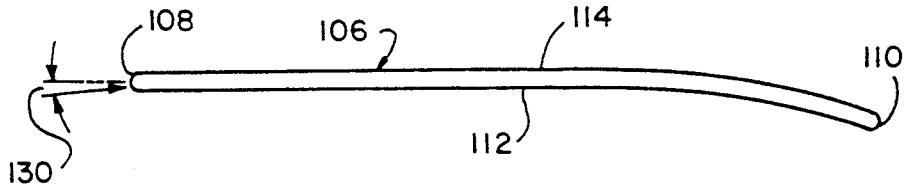
FIG. 12 PRIOR ART
FIG. 12 is a propeller blade profile, as known in the prior art, and shows a low angle of attack.

FIG. 11 is the composite load on the propeller blade due to camber (curvature) and angle of attack, at a low angle 130, FIG. 12, for blade 106. The load curve in FIG. 11 is the sum of the load curves in FIGS. 5 and 8. The location of the resultant hydrodynamic force, or center of pressure, is shown at 132.

Upon initial acceleration of the boat, the angle of blade attack and slip is high, as shown at 126, FIG. 10. As boat speed increases to cruising speed, the angle of attack decreases to a lower angle, as shown at 130, FIG. 12. As angle of attack decreases from 126 to 130, the location of the resultant hydrodynamic force moves rearwardly along the pressure surface of the blade, as shown in FIGS. 9 and 11 where the location of the resultant hydrodynamic force has moved from point 128 rearwardly to point 132. Rearward movement of the location of the resultant hydrodynamic force with decreasing angles of attack is not conducive to up-pitching of variable pitch marine propellers. In fact, such rearward movement of the location of the resultant hydrodynamic force with decreasing angles of attack is the opposite of the desired hydrodynamic force characteristic. Up-pitching pivoting of the blade is aided by hydrodynamic force at the forward portion of the blade, not the rearward portion. At high angles of attack upon initial acceleration, it is desired that the blade be in a down-pitched position, which in turn would be aided by hydrodynamic force along the rearward portion of the blade, not the forward portion. As boat speed increases to cruising speed, it is desired that the blade be pivoted from the down-pitched position to the up-pitched position, which in turn would be aided by forward movement of the location of the resultant hydrodynamic force, not rearward movement of such force. Rearward movement of the location of the resultant hydrodynamic force with decreasing angles of attack opposes up-shifting pivoting of the blade. Furthermore, as illustrated in FIGS. 9 and 11, the higher the angle of attack the quicker the blade will up-pitch, which is the opposite of what is desired.

One manner of dealing with the noted undesirable hydrodynamic force characteristic, while still retaining desirable concave curvature and cupping of positive pressure frontside surface 112, is to locate the pivot axis of the blade rearwardly of the rearmost location 132 of the resultant hydrodynamic force, for example as shown at pivot axis 134, FIG. 11. In this manner, the location of the resultant hydrodynamic force is always forward of the pivot axis of the blade, and hence there is always an up-pitching moment regardless of the angle of attack. In this type of system, a positive locking mechanism can be used to prevent up-pitching pivoting of the blades until a given propeller speed is reached generating a given centrifugal force due to centrifugal weights, for example Speer U.S. Pat. No. 4,929,153. The hydrodynamic force relationships, however, are still opposite to those conducive to up-pitching. For example, even with rearward pivot axis 134, FIG. 11, the greatest up-pitching moment occurs upon initial acceleration at high angles of attack 126 due to the longer moment arm between pivot point 134 and resultant hydrodynamic force location point 128, FIG. 9. As boat speed increases, and angle of attack decreases to 130, FIG. 12, the up-pitching moment decreases due to rearward movement of the location of the resultant hydrodynamic force which decreases the up-pitching moment as shown by the shorter moment arm between pivot point 134 and resultant hydrodynamic force location point 132, FIG. 11. At the smaller angle of attack 130, there is still an up-pitching moment because point 132 is forward of pivot point 134, however such up-pitching moment is not as strong as that upon initial acceleration at high angles of attack 126. The high up-pitching moment upon initial acceleration would cause the blade to immediately up-pitch, and hence a locking mechanism is necessary to prevent same. The present invention eliminates the need for the noted locking mechanism. The invention also enables a more balanced blade pivot axis, i.e. eliminating the need to move the pivot axis so far rearwardly as in FIG. 11 at 134.

Rather than using a hydrodynamic force characteristic which shifts the location of the resultant hydrodynamic force rearwardly with decreasing angles of attack, the present system instead uses a hydrodynamic force characteristic wherein the location of the resultant hydrodynamic force moves forwardly with decreasing angles of attack. It is more desirable to shift the location of the resultant hydrodynamic force on the blade farther away from the pivot axis with decreasing angles of attack, rather than shifting the location of the resultant hydrodynamic force closer to the pivot axis with decreasing angles of attack as in FIGS. 9 and 11. The use of the noted hydrodynamic force characteristic opposite to that previously used in variable pitch propellers facilitates in combination significant improvements in simplified biasing and synchronizing mechanisms which are rugged, durable and less costly.

Figure 13:
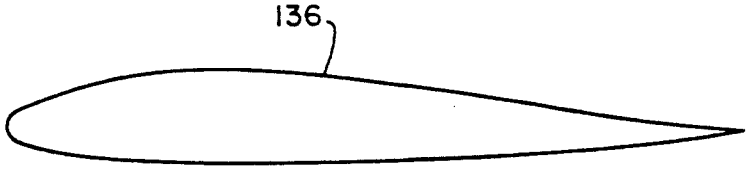
FIG. 13 PRIOR ART
FIG. 13 is a profile of an airfoil with a reflex trailing edge, as known in the prior art.

Airfoils with a center of pressure which moves forwardly with decreasing angles of attack are known in the prior art, "Handbook of Airfoil Sections For Light Aircraft", M. S. Rice, Aviation Publications, P.O. Box 123, Milwaukee, Wis. 53201, 1971, page 69. The blade profile shown on page 69 of the Rice reference is reproduced in FIG. 13 herein showing blade 136. This blade is a reflex trailing edge type blade, and was a starting point in applicant's attempt to use a hydrodynamic force characteristic which shifts the location of the resultant hydrodynamic force forwardly with decreasing angles of attack. Most airfoils have the opposite characteristic, and shift the center of pressure rearwardly with decreasing angles of attack, for example as shown on page 68 of the noted Rice reference. Though blade 136 is not suitable for marine applications nor for marine variable pitch propellers, the characteristic of this type of blade moving the center of pressure forwardly with decreasing angles of attack is desirable for up-pitching of pivoted marine propeller blades.

Figure 14:
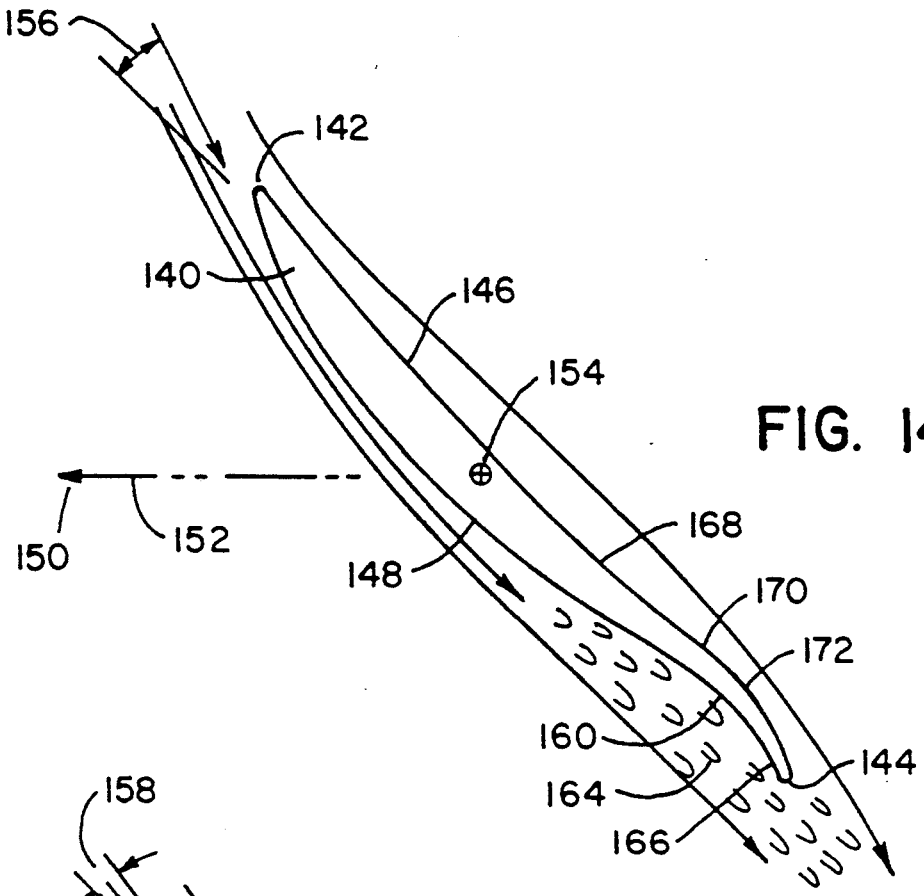
FIG. 14 shows the preferred blade profile of the present invention, and illustrates operation at a high angle of attack.
Figure 15:
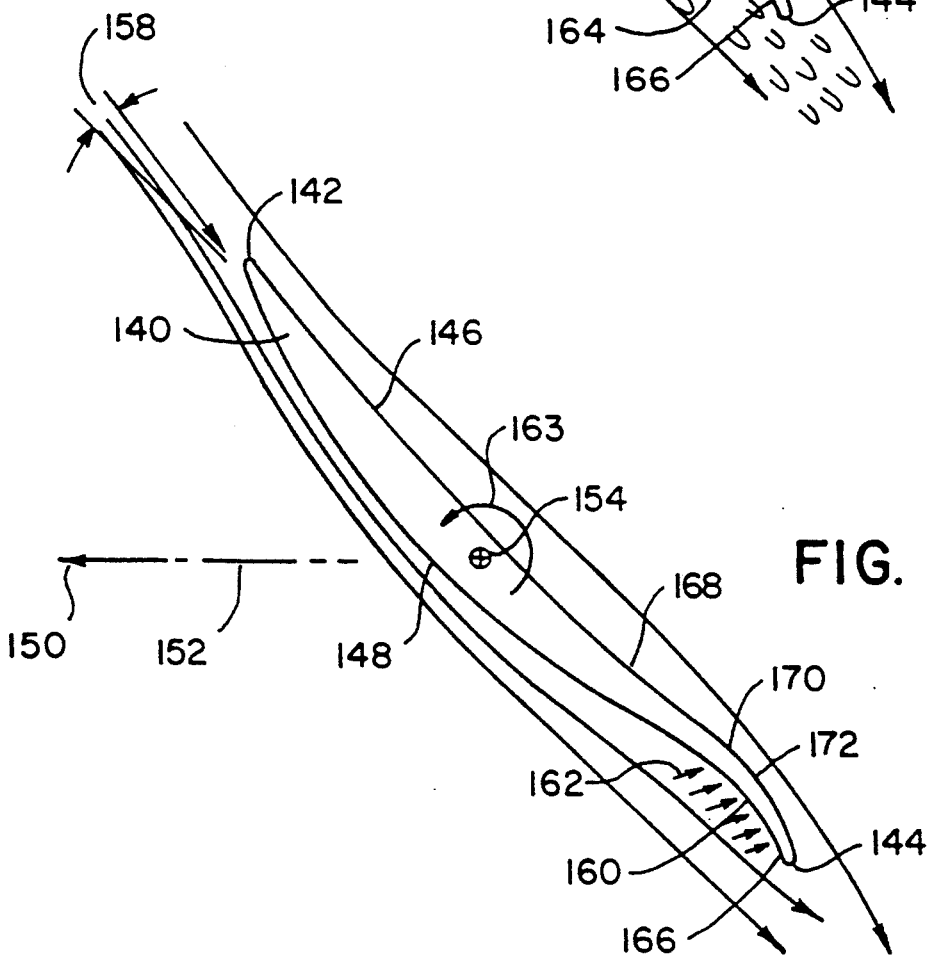
FIG. 15 is like FIG. 14 and illustrates operation at a low angle of attack.

FIGS. 14 and 15 show the profile of a blade 140 constructed in accordance with the invention, and illustrate hydrodynamic operation. Blade 140 has a forward leading portion 142, a rearward trailing portion 144, a positive pressure frontside surface 146 extending between forward leading portion 142 and rearward trailing portion 144, and a negative pressure backside surface 148 extending between forward leading portion 142 and rearward trailing portion 144 and facing oppositely from frontside surface 146 Arrow 150 shows the direction of propulsion, i.e. the boat is propelled to the left in FIGS. 14 and 15. Axis 152 is the longitudinal axis of rotation of the propeller hub. The blade extends radially outwardly from the propeller hub and is pivotable about radial pivot axis 154 between a low pitch position as shown in FIG. 14, and a high pitch position as shown in FIG. 15. The blade has a hydrodynamic force characteristic which shifts the location of the resultant hydrodynamic force on the blade in a direction aiding up-pitching of the blade with decreasing angles of attack. The hydrodynamic force characteristic increases the up-pitching pivot moment about pivot axis 154 with decreasing angles of attack, i.e. as angle of attack decreases from a high angle 156, FIG. 14, to a low angle 158, FIG. 15.

Blade 140 is provided with a counteractive hydrodynamic force generating area 160 which shifts the location of the resultant hydrodynamic force on frontside surface 146 with changing angle of attack, such that as angle of attack decreases, the location of the resultant hydrodynamic force on frontside surface 146 moves forwardly to cause pivoting of blade 140 to an increased pitch position, FIG. 15. The location of the resultant hydrodynamic force on frontside surface 146 moves from a point rearward of pivot axis 154 to a point forward of pivot axis 154 with decreasing angles of attack. Counteractive hydrodynamic force generating area 160 is at the rear of backside surface 148, such that blade 140 is pivoted by increased water flow along counteractive hydrodynamic force generating area 160 with decreasing angles of attack, which increased water flow generates a backside hydrodynamic force, shown at arrows 162, on blade 140 at counteractive hydrodynamic force generating area 160 spaced from pivot axis 154 by a moment arm provided by the section of blade 140 between pivot axis 154 and counteractive hydrodynamic force generating area 160, such that the backside hydrodynamic force 162 acting on the moment arm pivots the blade as shown at arrow 163 to an increased pitch position, FIG. 15.

The hydrodynamic force characteristic generates with hydrodynamic force on the blade an increasing up-pitching moment about the pivot axis with decreasing angles of attack, to pivot the blade to the increased pitch position. Counteractive hydrodynamic force generating area 160 on backside surface 148 at rearward trailing portion 144 is effective at decreasing angles of attack to generate a hydrodynamic force 162 generating an 140 to an increased pitch position, FIG. 15. Counteractive hydrodynamic force generating area 160 on backside surface 148 at rearward trailing portion 144 separates water flow, as shown at 164, FIG. 14, along backside surface 148 at rearward trailing portion 144 at high angles of attack 156, and re-attaches water flow, FIG. 15, along backside surface 148 at rearward trailing portion 144 at low angles of attack 158 to change backside surface 148 at rearward trailing portion 144 to a positive pressure area 160 to generate the up-pitching moment. Counteractive hydrodynamic force generating area 160 includes an upswept trailing edge 166 along backside surface 148 at rearward trailing portion 144 which has minimum water flow thereagainst and minimum force thereon at high angles of attack 156, and which has increased water flow thereagainst and increased force 162 thereon at low angles of attack 158.

Counteractive hydrodynamic force generating area 160 is effective at decreasing angles of attack to generate hydrodynamic force at 162 generating an up-pitching moment about pivot axis 154 to pivot blade 140 to an increased pitch position, FIG. 15. Counteractive hydrodynamic force generating area 160 is rearward of pivot axis 154 and is on backside surface 148. Frontside surface 146 has a section 168 of concave curvature facing a first direction. Counteractive hydrodynamic force generating area 160 is rearward of section 168 and has a concave curvature facing a second direction opposite to the noted first direction. Concave curvature section 168 of frontside surface 146 extends from forward leading portion 142 rearwardly to a transition area 170 located between pivot axis 154 and rearward trailing portion 144. Positive pressure area 160 on backside surface 148 is spaced rearwardly of pivot axis 154 and extends between transition area 170 and rearward trailing portion 144. Frontside surface 146 has a section 172 of convex curvature extending rearwardly from transition area 170 to rearward trailing portion 144 and facing the noted first direction. Positive pressure area 160 on backside surface 148 is on the backside of convex curvature section 172 of frontside surface 146.

Positive pressure area 160 on blade 140 is effective only at decreasing angles of attack to generate the up-pitching moment about pivot axis 154. At high angles of attack 156 there is positive hydrodynamic pressure on frontside surface 146. At low angles of attack 158 there is positive hydrodynamic pressure on both frontside surface 146 and positive pressure area 160 of backside surface 148. Counteractive hydrodynamic force generating area 160 on backside surface 148 changes such area of backside surface 148 to a positive pressure area at decreasing angles of attack to generate an up-pitching moment about pivot axis 154. This is accomplished by the above noted separation of water flow as shown at 164 for high angles of attack, FIG. 14, and reattachment of water flow, FIG. 15, at low angles of attack. The re-attachment at low angles of attack changes backside surface 148 at rearward trailing portion 144 to a positive pressure area 160, FIG. 15, to generate the up-pitching moment. Blade 140 has two positive pressure surfaces 168 and 160 which face oppositely. A trade-off of providing positive pressure surface 160 on backside 148 is increased drag at high speed due to upswept trailing edge 166. At start-up and at low speed, this is not a trade-off because at high angle of attack 156 the trailing edge 166 is not in the water flow path.

In the preferred embodiment, a centrifugal force mechanism, to be described, is provided in the hub and pivots the blades to the high pitch position with increasing propeller rotational speed, such that each blade is pivoted to its high pitch position by the combination of both backside hydrodynamic force and centrifugal force. The centrifugal force aides the up-pitching moment generated by the counteractive hydrodynamic force generating area 160 and enhances the up-pitching moment due to re-attached water flow. The inclusion of a centrifugal force mechanism in combination is preferred. If a centrifugal force mechanism is not used, then the pivot point of the blade is selected to lie between the forward and rearward locations of the resultant hydrodynamic force, or centers of pressure, as such location shifts as angle of attack decreases, such that the location of the resultant hydrodynamic force is rearward of the blade pivot axis at high angles of attack and moves forwardly and crosses the pivot axis as angle of attack decreases. The forward shifting of the location of the resultant hydrodynamic force from a point rearward of the point axis to a point forward of the pivot axis causes up-pitching of the blade from the FIG. 14 position to the FIG. 15 position. The use of a centrifugal force mechanism in combination is preferred because the balance point relative to the pivot axis is then not as critical because of the additional force component provided by the centrifugal weights. The positive backside force 162 provides an impetus or kick to start the up-pitching pivoting, and the centrifugal force continues such pivoting with increasing force due to increasing centrifugal force as radius increases due to outward movement of the centrifugal weights. The increasing centrifugal force can overcome the balance point of the blade pivot axis relative to movement of the location of the resultant hydrodynamic force, thus making such balance point less critical.

Figure 16:
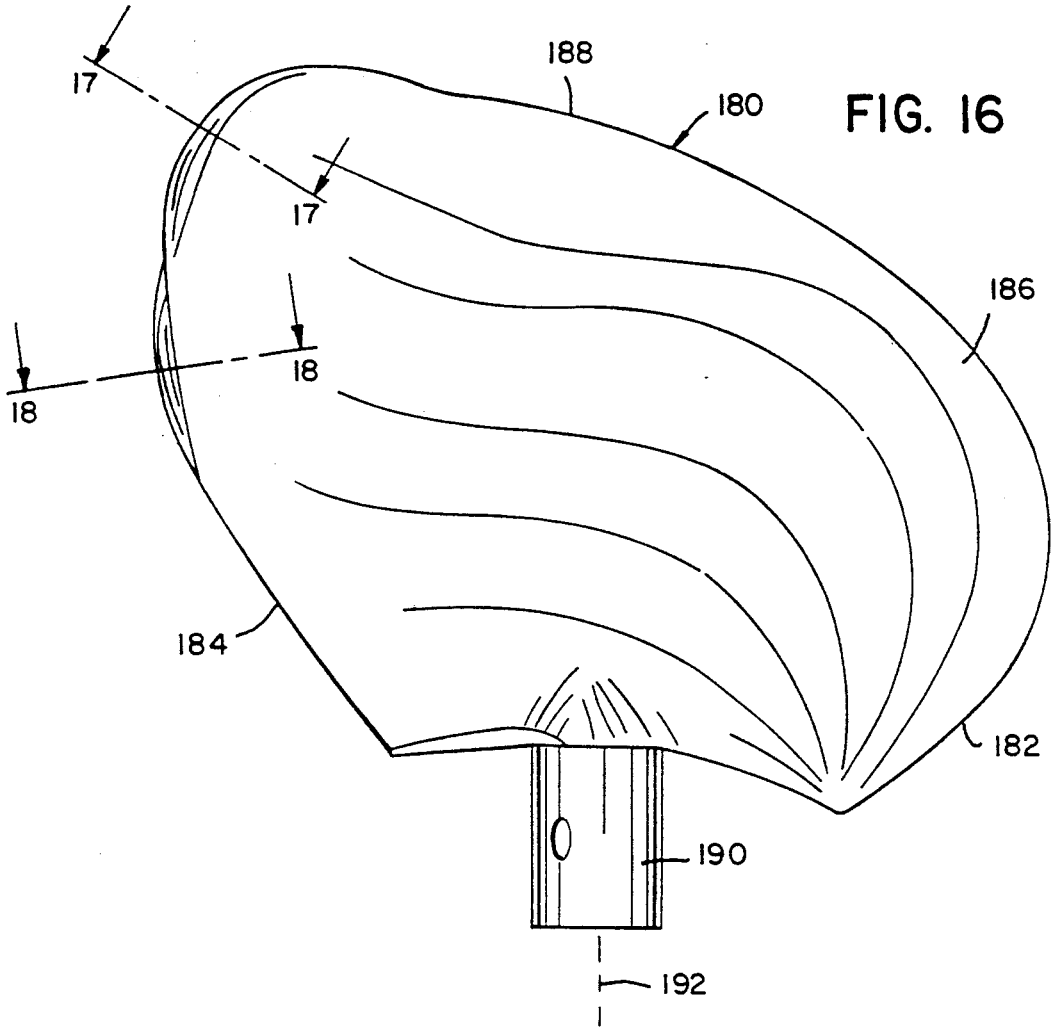
FIG. 16 shows a propeller blade used in one embodiment of the present invention.
Figure 17:
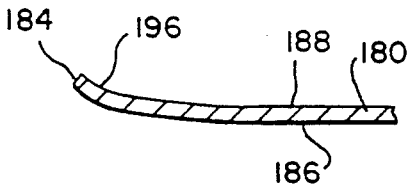
FIG. 17 is a sectional view taken along line 17—17 of FIG. 16.
Figure 18:
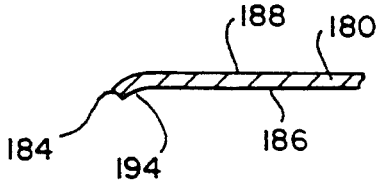
FIG. 18 is a sectional view taken along line 18—18 of FIG. 16.

FIGS. 16–18 show one embodiment of a pivotable marine propeller blade constructed in accordance with FIGS. 14 and 15. Blade 180 has a forward leading portion 182, a rearward trailing portion 184, a positive pressure frontside surface 186 extending between forward leading portion 182 and rearward trailing portion 184 and facing out of the page in FIG. 16, and a negative pressure backside surface 188 extending between forward leading portion 182 and rearward trailing portion 184 and facing oppositely from frontside surface 186. Blade 180 includes an integrally formed pivot trunnion 190 for mounting the blade to pivot about pivot axis 192. Frontside surface 186 has a cupped concave curvature section 194, FIG. 18, at rearward trailing portion 184 for providing thrust. Backside surface 188 has a counteractive hydrodynamic force generating area 196, FIG. 17, formed by a concave curvature section at rearward trailing portion 144 and performing as above described area 160 in FIGS. 14 and 15. Areas 194 and 196 are adjacent each other at the outer tip of the blade and have limited extension along the blade periphery.

Figure 19:
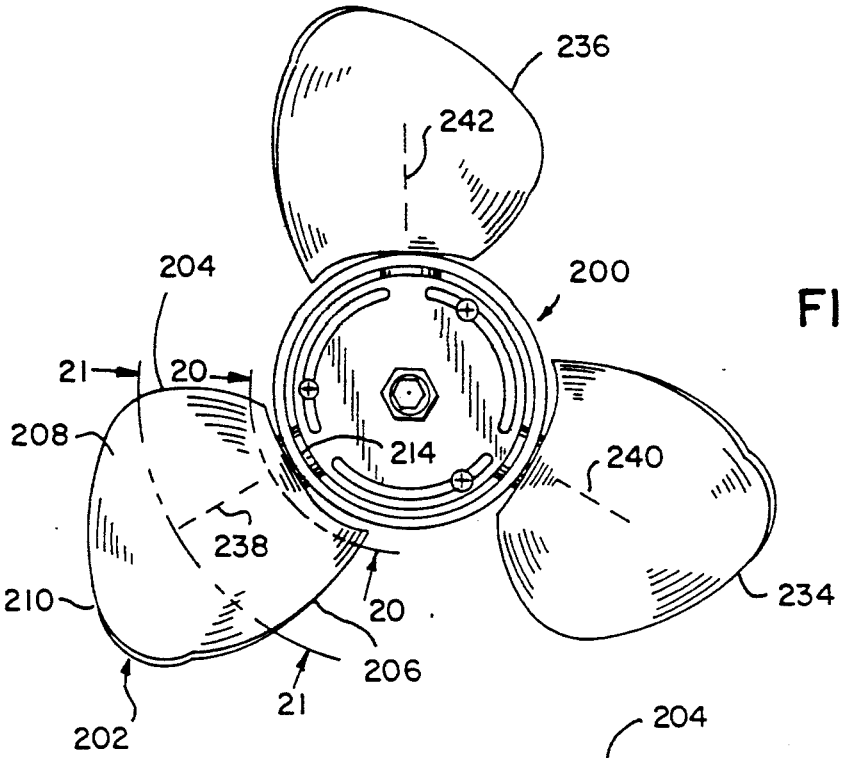
FIG. 19 is an end view of the preferred embodiment of a marine propeller in accordance with the present invention.
Figure 20:
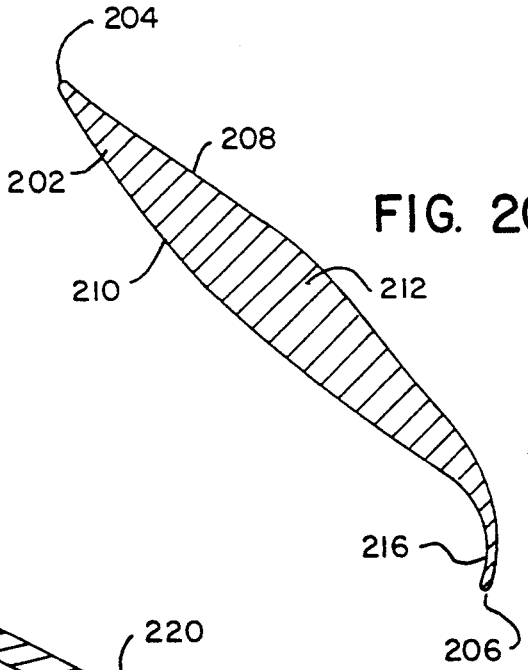
FIG. 20 is a sectional view taken along line 20—20 of FIG. 19.
Figure 21:
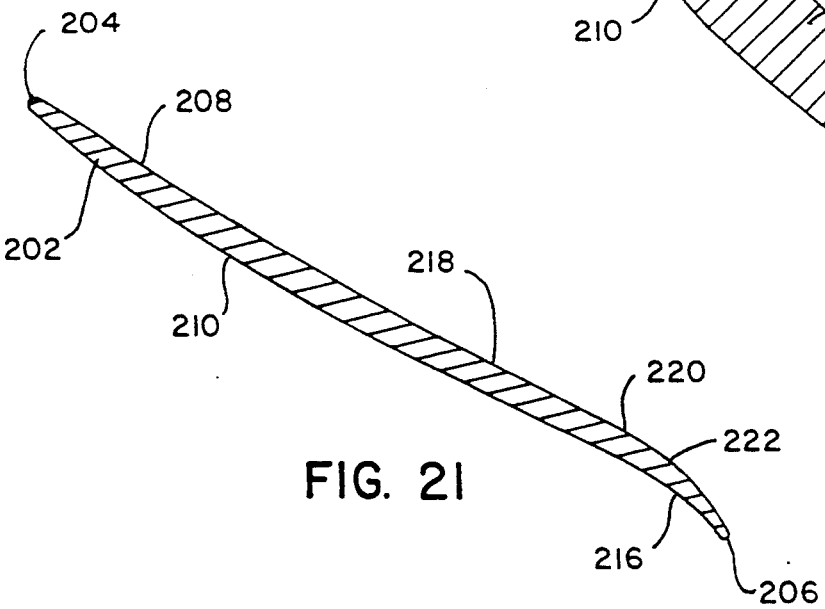
FIG. 21 is a sectional view taken along line 21—21 of FIG. 19.

FIGS. 19–21 show the preferred embodiment of a pivotable marine propeller blade constructed in accordance with FIGS. 14 and 15. FIG. 19 is an end view from the rear of a propeller 200 constructed in accordance with the invention, to be described. Propeller 200 is a right hand rotation propeller, though the invention is of course also applicable to left hand rotation propellers. Blade 202 has a forward leading portion 204, a rearward trailing portion 206, a positive pressure frontside surface 208 extending between forward leading portion 204 and rearward trailing portion 206 and facing out of the page in FIG. 19, and a negative pressure backside surface 210 extending between forward leading portion 204 and rearward trailing portion 206 and facing oppositely from frontside surface 208. FIG. 20 shows a blade section near the root of the blade, including increased stock thickness section 212 accommodating integrally formed pivot trunnion 214. FIG. 21 shows a blade section further out toward the middle of the blade. Counteractive hydrodynamic force generating area 216 is provided on backside surface 210 at rearward trailing portion 206 and performs as above described area 160 in FIGS. 14 and 15. Frontside surface 208 has a concave curvature section 218 for providing thrust, and merging at transition area 220 with convex curvature section 222.

Figure 23:
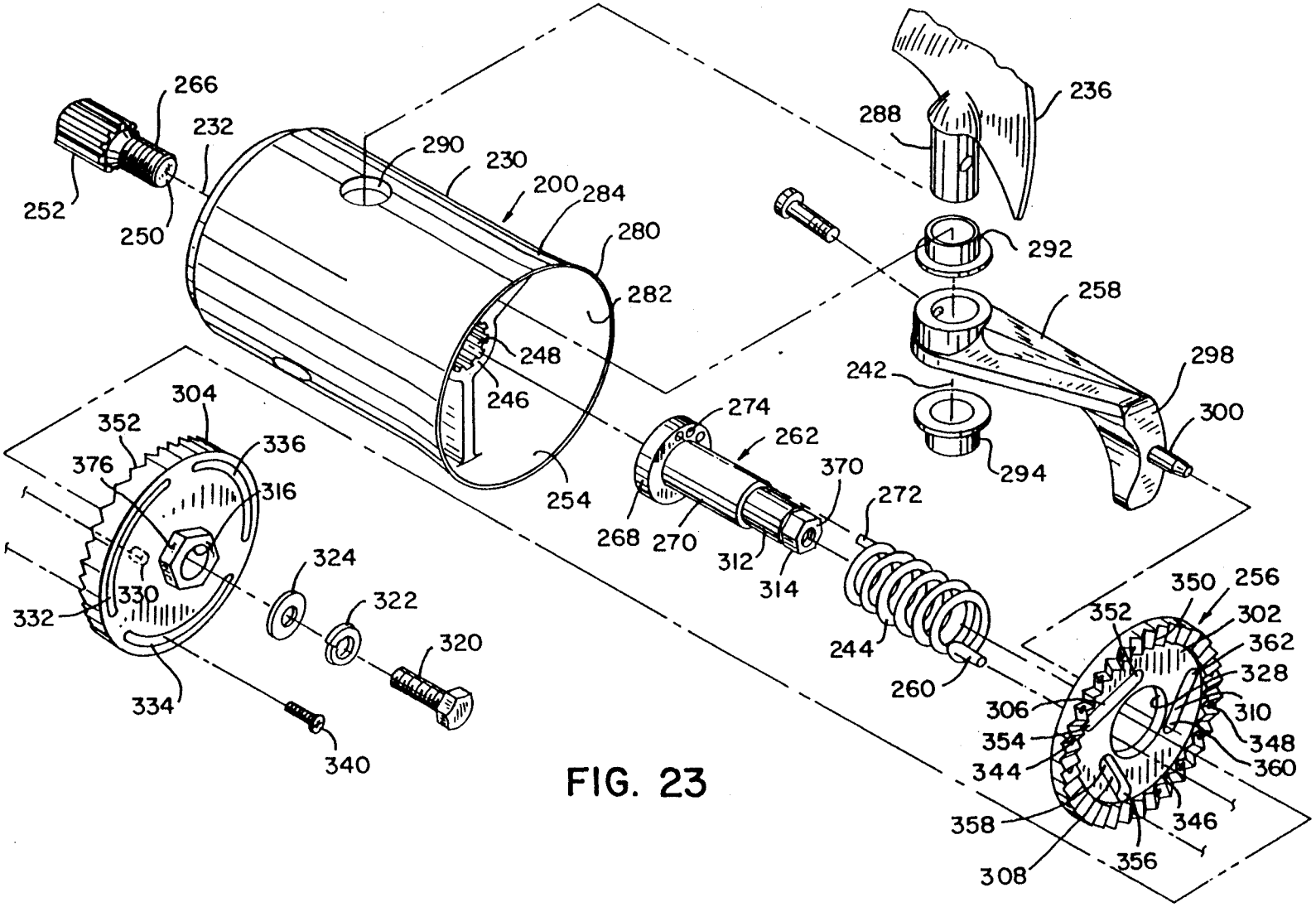
FIG. 23 is an exploded perspective view of the propeller of FIG. 22.

FIG. 22 is a perspective view of propeller 200, and FIG. 23 is an exploded perspective view. Propeller 200 includes a hub 230 rotatable about a longitudinal axis 232 and having blades 202, 234, 236, FIG. 19, extending radially outwardly therefrom and pivotable about respective radial pivot axes 238, 240, 242 between a low pitch position and a high pitch position. A torsional biasing spring 244 is coaxial with longitudinal axis 232 and biases the blades to their low pitch position, to be described. Hub 230 has a forward portion 246 with splines 248 mounted to propeller driveshaft 250 at splines 252. Hub 230 has a rearward portion 254 receiving biasing spring 244. A preload mechanism 256 is mounted at the rearward portion of the hub and is connected to the blades by respective lever arms such as 258. Spring 244 is rearward of radial pivot axes 238, 240, 242 and has a rearward end 260 mounted to preload mechanism 256 and fixed relative thereto and biasing the blades to the low pitch position. As will be described, the preload mechanism is adjustably mounted between the lever arms and the spring to adjust preload bias biasing the blades to the low pitch position.

A longitudinally extended propeller nut 262 mounts hub 230 to propeller driveshaft 250. Nut 262 has an internal threaded portion 264, FIG. 24, thread-mounted to driveshaft 250 at threads 266, FIG. 23. Nut 262 has a forward flange 268, and a barrel section 270 extending rearwardly from forward flange 268. Preload mechanism 256 is mounted to the rearward end of extended nut 262 and is spaced rearwardly of forward flange 268. Torsion spring 244 is coiled around barrel section 270 and extends between forward flange 268 and preload mechanism 256 and is secured respectively to each. Spring 244 has a forward end 272 received in one of holes 274 in forward flange 268. Preload mechanism 256 is rotatably mounted on extended nut 262 and rotatable about longitudinal axis 232 between a first angular position corresponding to the low pitch position of the blades, and a second angular position corresponding to the high pitch position of the blades, to be described. Rotation of the preload mechanism about longitudinal axis 232 from the noted first angular position to the noted second angular position is against the torsional bias of spring 244.

Hub 230 has a cylindrical sidewall 280 with an inner surface 282 defining the interior of the hub, and an outer surface 284 defining the exterior of the hub. Pivot trunnions 214, 286, 288, FIG. 25, extend radially through cylindrical sidewall 280 and have outer ends attached to respective blades 202, 234, 236, preferably by being integrally cast therewith, or by welding or the like. Pivot trunnions 214, 286, 288 have inner ends in the interior of the hub. Pivot trunnion 288, FIG. 23, extends through opening 290 in cylindrical sidewall 280 and is supported in bearing bushings 292 and 294. Lever arm 258 is mounted to trunnion 288 by threaded cap screw 296, FIGS. 23 and 24. Lever arm 258 extends rearwardly from trunnion 288 and includes a heavy stock outer portion 298, FIG. 23, providing a centrifugal weight, and an outer end 300 providing a guide pin for interacting with the preload mechanism 256 which also performs a synchronizing function preventing blade flutter, to be described. As centrifugal weight 298 of lever arm 258 moves radially outwardly away from axis 232, such movement pivots blade 236 to its high pitch position. Lever arm 258 extends rearwardly in the interior of the hub from trunnion 288 and is movable between a first inward position close to axis 232 and corresponding to the low pitch position of blade 236, and a second outward position away from axis 232 and corresponding to the high pitch position of blade 236.

Figure 24:
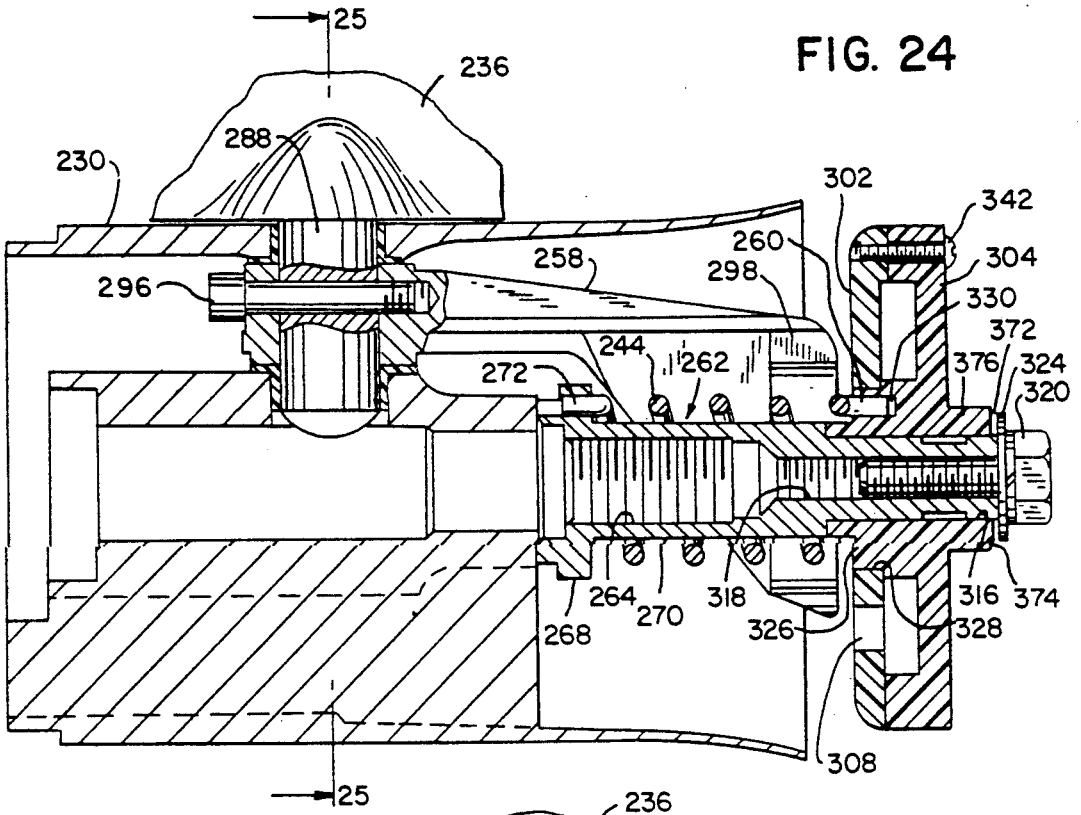
FIG. 24 is a sectional view of a portion of the structure of FIG. 22.
Figure 25:
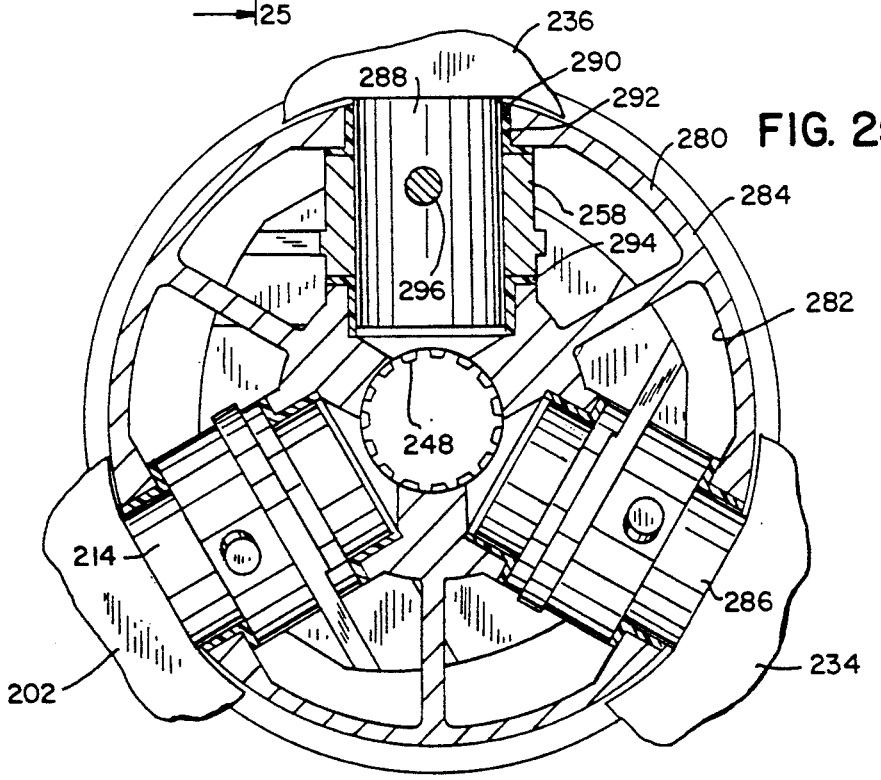
FIG. 25 is a sectional view taken along line 25—25 of FIG. 24.

Preload mechanism 256 includes a first disc 302 and a second disc 304, FIGS. 23 and 24. Disc 302 has guide slots 306, 308, 310 each receiving and retaining a respective rear end guide pin such as 300 of a respective lever arm and restricting movement of the guide pins of the lever arms along the guide slots such that the lever arms can move only in unison between their noted inward and outward positions corresponding respectively to low pitch and high pitch positions of their respective blades. This unified movement provides synchronism of the blades, and prevents one blade from up-shifting earlier than another blade, known as blade flutter.

Discs 302 and 304 are generally flat planar plate-like members extending radially outwardly from longitudinal axis 232 and lying in planes perpendicular to longitudinal axis 232. Extended propeller nut 262 has a reduced diameter section 312 extending rearwardly from barrel section 270, and a hex configuration outer end 314 for tightening nut 262 onto propeller shaft 250. Disc 304 has a central aperture 316 through which reduced diameter nut section 312 extends for rotatably mounting disc 304 on nut section 312. Nut sections 312 and 314 are internally threaded at 318, FIG. 24, for receiving a threaded mounting bolt 320 for holding disc 304 on nut 262 with washers 322 and 324. Disc 304 has a central forwardly extending shank portion 326 on which disc 302 is rotatably mounted at central aperture 328. Shank portion 326 has a hole 330 receiving forward end 260 of spring 244. Disc 304 has peripheral arcuate slots 332, 334, 336 through which respective screws 338, 340, 342, FIG. 22, extend and are threaded into respective threaded openings 344, 346, 348, FIG. 23, in disc 302, to mount the discs to each other. The discs have respective indexing serrations 350 and 352 providing indexing structure for adjustably changing the angular positions of discs 302 and 304 relative to each other to change the bias on disc 302 biasing the propeller blades to their low pitch position, to be described. Spring 244 engaging disc 304 biases the latter to a given angular position which in turn biases disc 302 to the given angular position.

Figure 26:
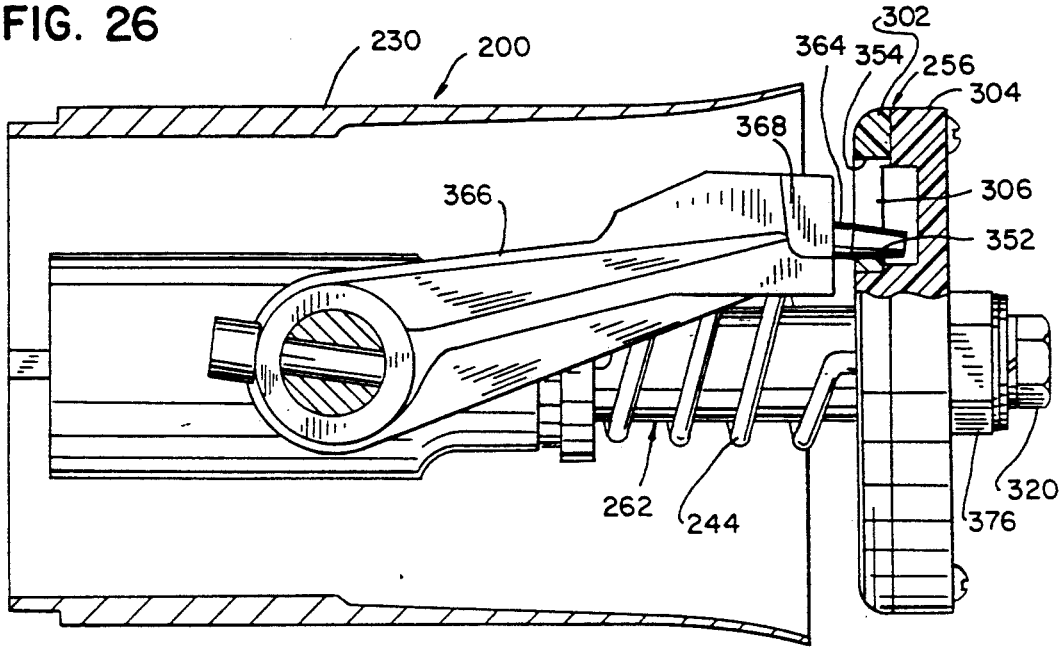
FIG. 26 is a partial sectional view of a portion of the structure of FIG. 22, and shows a down-pitched blade position.
Figure 27:
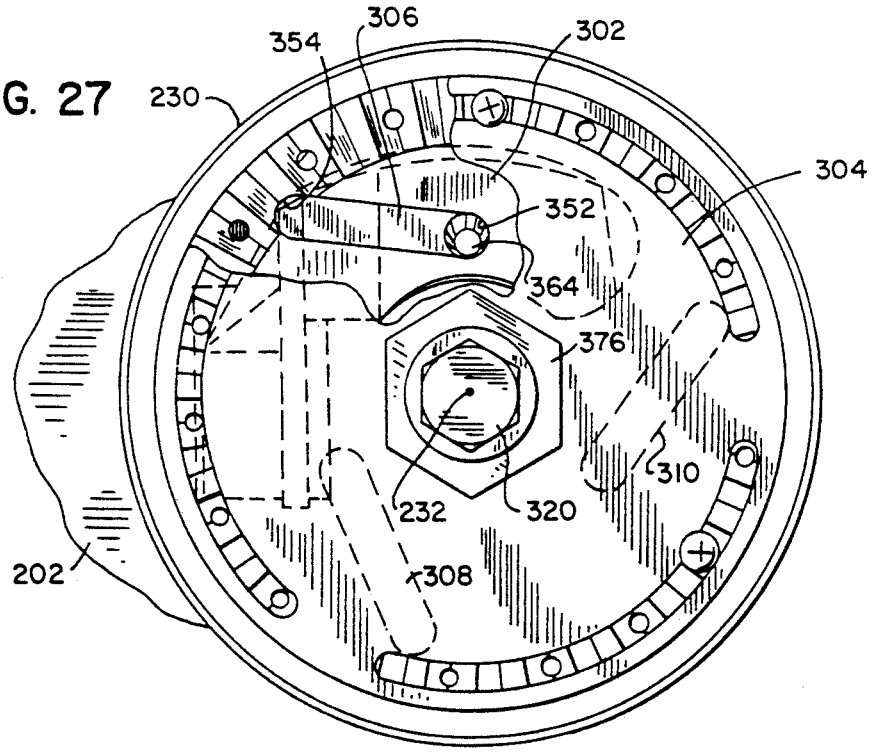
FIG. 27 is an end view of the structure of FIG. 26 in the down-pitched position.
Figure 28:
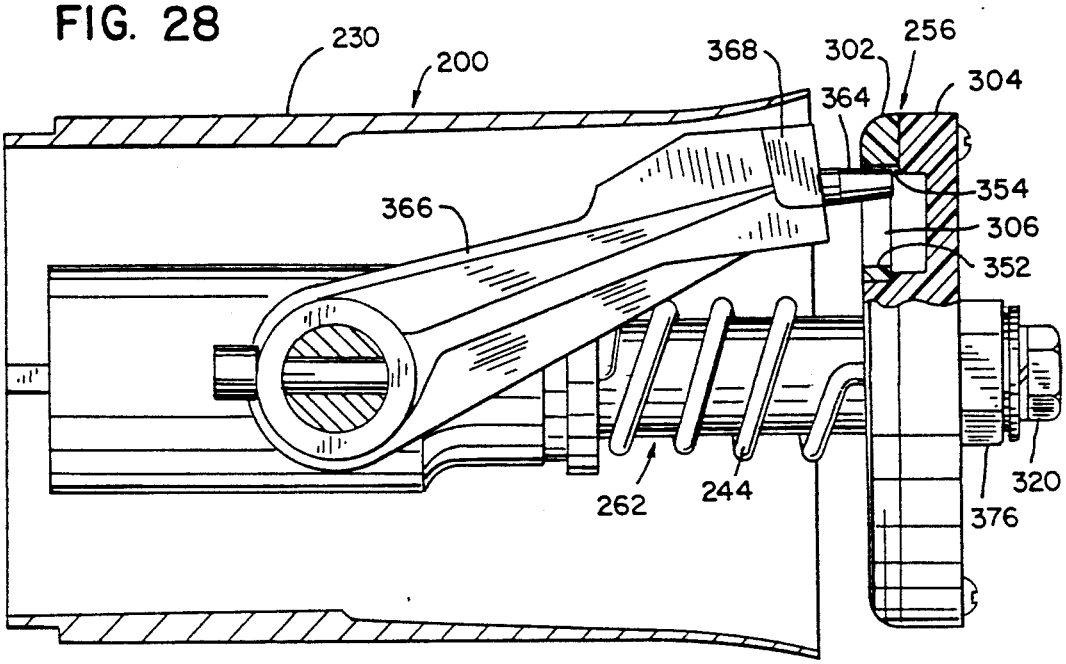
FIG. 28 is like FIG. 26, but shows an up-pitched blade position.
Figure 29:
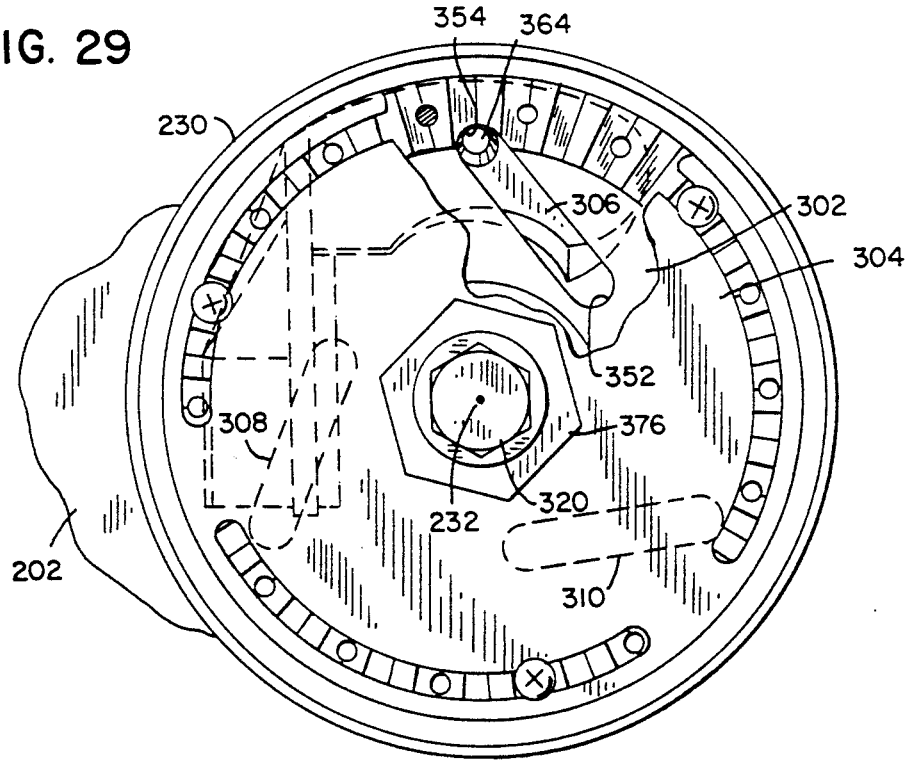
FIG. 29 is an end view of the structure of FIG. 28 in the up-pitched position.

Each guide slot 306, 308, 310 extends along a given length between inner and outer ends 352 and 354, 356 and 358, 360 and 362, respectively. Each lever arm at its rear guide pin moves along the respective guide slot from the inner end of the guide slot defining the low pitch position of the respective blade to the outer end of the guide slot defining the high pitch position. For example, FIGS. 26 and 27 show guide pin 364 of lever arm 366 at inner end 352 of guide slot 306, defining the low pitch position of blade 202. FIGS. 28 and 29 show guide pin 364 of lever arm 366 at outer end 354 of guide slot 306, defining the high pitch position of blade 202. Disc 302, with disc 304, is rotatable relative to hub 230 about longitudinal axis 232. Guide slots 306, 308, 310 are spaced radially outwardly of longitudinal axis 232 such that the guide slots move in an arc about longitudinal axis 232 upon rotation of the discs. Pivoting of blade 202 is controlled by both: a) movement of guide pin 364 of lever arm 366 along guide slot 306; and b) arcuate movement of guide slot 306 as disc 302 rotates about longitudinal axis 232. Pivoting of blade 202 from its low pitch position to its high pitch position requires both: a) movement of guide pin 364 of lever arm 366 along guide slot 306; and b) rotation of disc 302 clockwise in FIG. 27 to arcuately move guide slot 306 to the position shown in FIG. 29. Guide pin 364 at the rearward end of lever arm 366 moves radially relative to longitudinal axis 232. The radial movement of guide pin 364 is perpendicular to pivot axis 238 of blade 202. Lever arm 366 includes at its rearward end an increased stock thickness section 368 providing a centrifugal weight moving radially outwardly due to centrifugal force with increasing propeller rotational speed, to pivot blade 202 to its high pitch position. Guide slot 306 extends obliquely relative to the radial direction of movement of guide pin 364 and centrifugal weight 368. Guide slot 306 also extends obliquely to the tangent of the noted arcuate movement of the guide slot. The remaining guide slots and lever arms and their interaction is comparable. Disc 302 prevents blade flutter by preventing one blade from pivoting earlier than another blade, and instead requires that the lever arms move in unison, i.e. one lever arm cannot move radially outwardly without causing clockwise rotation, FIG. 27, of disc 302, which in turn requires the other lever arms to move radially outwardly along their respective guide slots.

Coil spring 244 biases disc 304 and hence disc 302 to the counterclockwise rotated position shown in FIG. 27 corresponding to the low pitch position of the propeller blades. Pivoting of the blades from the low pitch position, FIG. 27, to the high pitch position, FIG. 29, must move the lever arms at their rearward guide pins along respective guide slots 306, 308, 310 and arcuately move the guide slots by overcoming biasing spring 244 to rotate the discs. As above noted, each propeller blade has a counteractive hydrodynamic force generating area 160, FIGS. 14 and 15, 216, FIG. 21, generating an up-pitching moment about the respective blade pivot axis which moment increases with decreasing angles of attack to pivot the blade to its high pitch position. The noted centrifugal force acting in combination with the noted hydrodynamic force generating said up-pitching moment overcome biasing spring 244 at decreasing angles of attack and pivot the blade to its high pitch position.

Disc 304 provides a preload mechanism accessible at the rear of the hub for adjusting the bias of biasing spring 244 and the amount of the combinational force of the centrifugal force and the hydrodynamic force required to overcome the bias of biasing spring 244. The preload bias is adjusted by loosening bolt 320, then loosening and removing screws 338, 340, 342, then sliding disc 304 rearwardly until serrations 352 of disc 304 are spaced slightly rearwardly of serrations 350 of disc 302, then turning disc 304 clockwise to provide higher preload bias, or counterclockwise to provide lower preload bias, then moving disc 304 longitudinally forwardly until serrations 352 engage and nest in serrations 350, then reinserting and tightening screws 338, 340, 342, and tightening bolt 320. Bolt 320 is tightened until washer 324 is seated against the rearward end face 370 of extended propeller nut 262, and split washer 322 is slightly flattened. In this condition, there is a slight gap 372, FIG. 24, between washer 324 and the rear end face 374 of central raised section 376 of disc 304, such that the disc may rotate on section 312 of extended propeller hub nut 262. Section 376 of disc 304 has an outer hex configuration to facilitate the noted adjustment.

Figure 30:
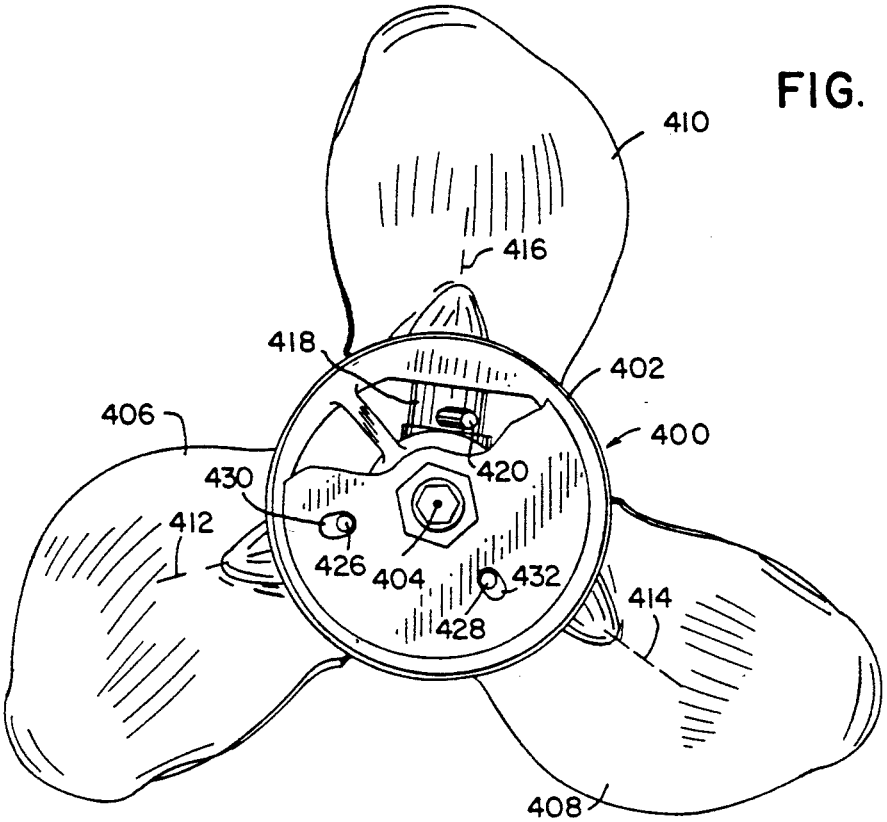
FIG. 30 is an end view of an alternate embodiment marine propeller in accordance with the invention.
Figure 31:
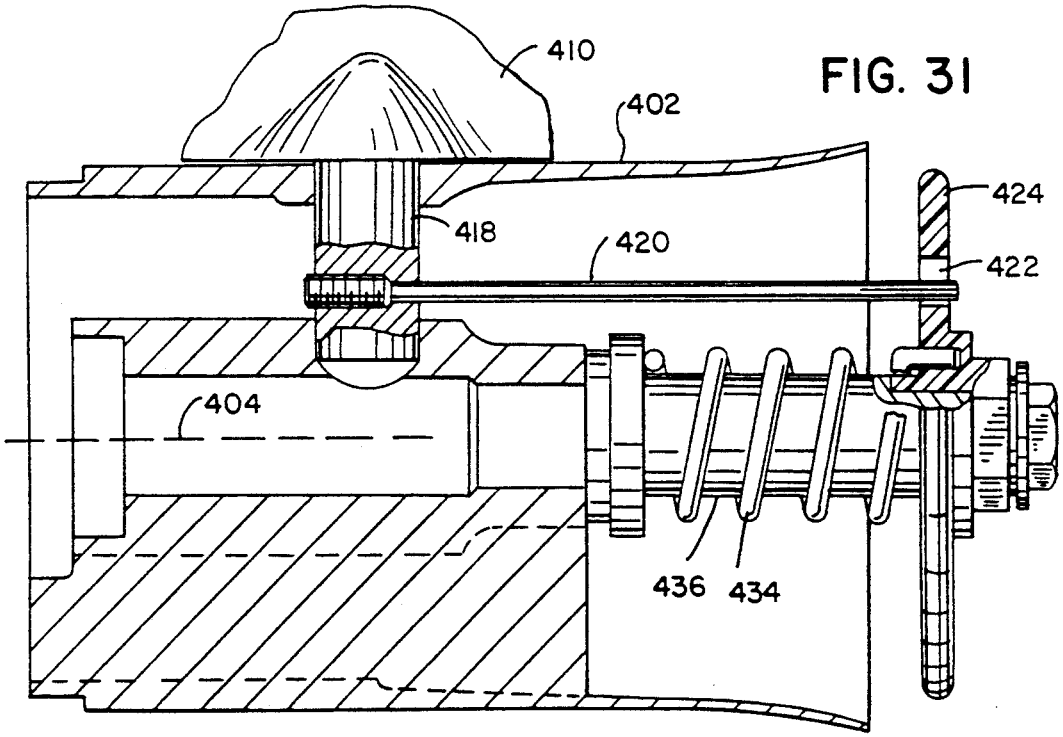
FIG. 31 is a partial sectional view of a portion of the structure of FIG. 30.

FIGS. 30 and 31 show an alternate embodiment marine propeller 400 including a hub 402 rotatable about a longitudinal axis 404 and having blades 406, 408, 410 extending radially outwardly therefrom and pivotable about respective radial pivot axes 412, 414, 416 on respective trunnions such as 418, and pivot between a low pitch position and a high pitch position. An arm 420 extends rearwardly from trunnion 418 and has a rearward end received in a respective guide slot 422 of disc 424. Arms 426 and 428 extend rearwardly from respective trunnions of blades 406 and 408 and are received in respective guide slots 430 and 432 of disc 424. Biasing spring 434 coiled around extended propeller mounting nut 436 biases disc 424 to a rotated position about longitudinal axis 404 corresponding to the low pitch position of the blades. Guide slots 420, 430, 432 move in to arc about longitudinal axis 404 as disc 424 rotates, comparably to disc 302, FIGS. 27 and 29. In the embodiment in FIG. 31, there are no centrifugal weights on arms 420, 426, 428, and such arms move in a direction tangent to the noted arcuate movement, not along a radius relative to longitudinal axis 404. The embodiment in FIG. 31 relies only on the noted hydrodynamic force to up-pitch the blades. Disc 424 provides the noted synchronizing mechanism such that arms 420, 426, 428 can move only in unison, thus preventing blade flutter.

It is recognized that various equivalents, alternatives and modifications are possible within the scope of the appended claims.

We claim:

1. A marine propeller comprising a hub rotatable about a longitudinal axis and having a plurality of blades extending radially outwardly therefrom and pivotable about respective radial pivot axes between a low pitch position and a high pitch position, and a biasing spring coaxial with said longitudinal axis of rotation of said hub and biasing said blades to said low pitch position, wherein said hub has a forward portion mountable to a propeller driveshaft, and a rearward portion, and comprising a preload mechanism at said rearward portion and connected to said blades by a plurality of respective lever arms, wherein said spring is rearward of said radial pivot axes and has a rearward end mounted to said preload mechanism and fixed relative thereto and biasing said blades to said low pitch position, said lever arms having rearward ends slidable along said preload mechanism along a radial direction perpendicular to said longitudinal axis.

2. A marine propeller comprising a hub rotatable about a longitudinal axis and having a plurality of blades extending radially outwardly therefrom and pivotable about respective radial pivot axes between a low pitch position and a high pitch position, and a biasing spring coaxial with said longitudinal axis of rotation of said hub and biasing said blades to said low pitch position, a plurality of lever arms connected to respective said blades and extending rearwardly within said hub, and a preload mechanism adjustable mounted between said lever arms and said spring to adjust preload bias biasing said blades to said low pitch position, each lever arm having a forward end nonrotatably mounted to a respective said blade at said pivot axis and pivotable therewith such that said blade and said lever arm have the same pivot axis and pivot in unison thereabout.

3. The propeller according to claim 2 wherein said preload mechanism comprises an adjustment member rotatable about said longitudinal axis at the rear of said hub and user-accessible thereat for changing the shift point of said blades in up-shifting from said low pitch position to said high pitch position.

4. A marine propeller comprising a hub rotatable about a longitudinal axis and having a plurality of blades extending radially outwardly therefrom and pivotable about respective radial pivot axes between a low pitch position and a high pitch position, said hub comprising a cylindrical sidewall having an inner surface defining the interior of said hub, and an outer surface defining the exterior of said hub, a plurality of trunnions extending radially through said cylindrical sidewall and having outer ends attached to respective said blades, and having inner ends in the interior of said hub, a plurality of lever arms each extending rearwardly in the interior of said hub from a respective said trunnion, each lever arm being movable between a first position corresponding to said low pitch position of its respective said blade, and a second position corresponding to said high pitch position of its respective said blade, a disc having a plurality of guide slots each receiving and retaining a respective said lever arm and restricting movement of said lever arms along said guide slos such that said lever arms can move only in unison between said first and second positions, said lever arms having rearward ends slidable along said disc away from said longitudinal axis, each lever arm having a forward end nonrotatably mounted to a respective said blade at said pivot axis and pivotable therewith such that said blade and said lever arm have the same pivot axis and pivot in unison thereabout.

5. The propeller according to claim 1 wherein said disc is a generally flat planar plate-like member extending radially outwardly from said longitudinal axis and lying in a plane perpendicular to said longitudinal axis, and wherein each said guide slot extends along a given length between first and second ends, and each said lever arm moves along the respective said guide slot from said first end of said guide slot defining said low pitch position to said second end of said guide slot defining said high pitch position.

6. The propeller according to claim 4 wherein said disc is rotatable relative to said hub about said longitudinal axis of rotation of said hub, and wherein said guide slots are spaced radially outwardly of said longitudinal axis such that said guide slots move in an arc about said longitudinal axis upon rotation of said disc, such that pivoting of said blades is controlled by both a) movement of said lever arms along said guide slots, and b) arcuate movement of said guide slots as said disc rotates about said longitudinal axis, and such that pivoting of each said blade from said low pitch position to said high pitch position requires both a) movement of the respective said lever arm along its respective said guide slot, and b) rotation of said disc to arcuately move said guide slot.

7. The propeller according to claim 4 wherein said lever arms have rearward ends which move radially relative to said longitudinal axis, the radial movement of each said rearward end of each lever arm being generally perpendicular to the pivot axis of its respective said blade, each said lever arm at said rearward end including a centrifugal weight moving radially outwardly due to centrifugal force with increasing propeller rotational speed, to pivot said blades to said high pitch position.

8. The propeller according to claim 4 wherein said lever arms have rearward ends which move radially relative to said longitudinal axis, each said guide slot extends obliquely relative to the radial direction of movement of its respective said rearward end of said lever arm, each said guide slot extending along a given length between first and second ends, and each said lever arm at said rearward end moving along the respective said guide slot from said first end of said guide slot defining said low pitch position to said second end of said guide slot defining said high pitch position, wherein said disc is rotatable relative to said hub about said longitudinal axis of rotation of said hub, and wherein said guide slots are spaced radially outwardly of said longitudinal axis such that said guide slots, including said first and second ends thereof, move in an arc about said longitudinal axis upon rotation of said disc, such that pivoting of said blades is controlled by both a) movement of said rearward ends of said lever arms along said guide slots, and b) arcuate movement of said guide slots as said disc rotates about said longitudinal axis, and such that pivoting of each said blade from said low pitch position to said high pitch position requires both a) movement of the respective rearward end of said lever arm along its respective said guide slot, and b) rotation of said disc to arcuately move said guide slot.

9. The propeller according to claim 4 wherein said disc is rotatable relative to said hub about said longitudinal axis of said hub, and said guide slots are spaced radially outwardly of said longitudinal axis such that said guide slots move in an arc about said longitudinal axis upon rotation of said disc, and wherein each said guide slot extends obliquely to the tangent of said arcuate movement.

10. The propeller according to claim 4 wherein each said guide slot extends along a straight line.

11. The propeller according to claim 4 wherein said disc is rotatable relative to said hub about said longitudinal axis of rotation of said hub, and wherein said guide slots are spaced radially outwardly of said longitudinal axis such that said guide slots move in an arc about said longitudinal axis upon rotation of said disc, and comprising a biasing spring biasing said disc to a first rotated position corresponding to said low pitch position of said blades, such that pivoting of said blades from said low pitch position to said high pitch position must move said lever arms along said guide slots and arcuately move said guide slots by overcoming said biasing spring to rotate said disc.

12. The propeller according to claim 4 wherein said disc is rotatable relative to said hub about said longitudinal axis of rotation of said hub, said hub has a forward portion mountable to a propeller driveshaft by an extended propeller nut, and a rearward portion receiving a biasing spring biasing said disc to a first rotated position corresponding to said low pitch position of said blades, and comprising a second disc rearwardly of and fixedly mounted to said first mentioned disc, said discs having central aligned apertures through which said extended propeller nut extends.

13. The propeller according to claim 4 comprising a second disc engaging said first mentioned disc, and biasing means engaging and biasing said second disc corresponding to in turn bias said first disc to a first position corresponding to said low pitch position of said blades, and comprising indexing means for adjustably changing the angular positions of said first and second discs relative to each other to change the bias on said first disc biasing said blades to said low pitch position.

14. A marine propeller comprising a hub rotatable about a longitudinal axis and having a plurality of blades extending radially outwardly therefrom and pivotable about respective radial pivot axes between a low position and a high pitch position, said hub comprising a cylindrical sidewall having an inner surface defining the interior of said hub, and an outer surface defining the exterior of said hub, a plurality of trunnions extending radially through said cylindrical sidewall and having outer ends attached to respective said blades, and having inner ends in the interior of said hub, a plurality of lever arms each extending rearwardly in the interior of said hub from a respective said trunnion, each lever arm being movable between a first position corresponding to said low pitch position of its respective said blade, and a second position corresponding to said high pitch position of its respective said blade, wherein said lever arms have centrifugal weights moving outwardly due to centrifugal force with increasing propeller rotational speed, to pivot said blades to said high pitch position, and wherein each said blade has a counteractive hydrodynamic force generating area generating an up-pitching moment about the respective pivot axis which moment increases with decreasing angle of attack to pivot said blade to said high pitch position, said centrifugal force acting in combination with said hydrodynamic force generating said up-pitching moment to pivot said blade to said high pitch position, said lever arms having rearward ends slidable along said preload mechanism outwardly of said longitudinal axis, each lever arm having a forward end nonrotatably mounted to a respective said blade at a respective said trunnion at said pivot axis and pivotable therewith such that said blade and said lever arm have the same pivot axis and pivot in unison thereabout, such that said rearward ends of said lever arms art movable solely in an arc about the respective pivot axis of the respective blade.

15. The propeller according to claim 14 comprising a biasing spring biasing said blades to said low pitch position, and wherein the combination of said centrifugal force and said hydrodynamic force generating said up-pitching moment together overcome said biasing spring at decreasing angles of attack.

16. The propeller according to claim 14 comprising a biasing spring coaxial with the longitudinal axis of rotation of said hub and extending rearwardly to a preload mechanism accessible at the rear of said hub for adjusting the bias of said biasing spring, the combination of said centrifugal force and said hydrodynamic force generating said up-pitching moment together overcoming said biasing spring at decreasing angles of attack, said preload mechanism adjusting the bias of said biasing spring and the amount of the combinational force of said centrifugal force and said hydrodynamic force generating said up-pitching moment required to overcome the bias of said biasing spring.

17. The propeller according to claim 14 comprising a disc having a plurality of guide slots each receiving and retaining a respective said lever arm and restricting movement of said lever arms along said guide slots such that said lever arms can move only in unison between said first and second positions.

* * * * *

UNITED STATES PATENT AND TRADEMARK OFFICE

CERTIFICATE OF CORRECTION

PATENT NO. : 5,290,147

DATED : March 1, 1994

INVENTOR(S) : MICHAEL A. KARLS ET AL

It is certified that error appears in the above-identified patent and that said Letters Patent is hereby corrected as shown below:

CLAIM 2, Col. 13, Line 34, delete "adjustable" and substitute, therefor -- adjustably --; CLAIM 4, Col. 13, Line 66, delete "slos" and substitute therefor -- slots --; CLAIM 5, Col. 14, Line 7, delete "1" and substitute therefor -- 4 --; CLAIM 13, Col. 15, Line 45, before "to in turn" delete "corresponding"; CLAIM 14, Col. 15, Line 54, after "low" insert -- pitch --; CLAIM 14, Col. 16, Line 17, delete "angle" and substitute therefor -- angles --; CLAIM 14, Col. 16, Line 30, delete "art" and substitute therefor -- are --.

Signed and Sealed this

Thirteenth Day of September, 1994

*Attest:*

Bruce Lehman

BRUCE LEHMAN

*Attesting Officer*

*Commissioner of Patents and Trademarks*